United States Patent [19]

Arita et al.

[11] 4,357,225

[45] Nov. 2, 1982

[54] CATHODE BASE PLATE FOR ELECTROLYTIC REFINING

[75] Inventors: Satoshi Arita; Kiyomi Touge; Akio Shida; Sigenobu Yamaura, all of Gifu, Japan

[73] Assignee: Mitsui Mining & Smelting Co., Ltd., Tokyo, Japan

[21] Appl. No.: 187,376

[22] Filed: Sep. 15, 1980

[30] Foreign Application Priority Data

Sep. 20, 1979 [JP] Japan ..... 54-130243[U]

[51] Int. Cl.[3] ..... C25D 7/00; C25D 1/20

[52] U.S. Cl. ..... 204/281; 204/12

[58] Field of Search ..... 204/281, 12, 194, 181

[56] References Cited

U.S. PATENT DOCUMENTS

| | | | |
|---|---|---|---|
| 724,862 | 4/1903 | Henry | 204/281 |
| 3,980,548 | 9/1976 | Sekine et al. | 204/281 |
| 4,207,147 | 6/1980 | Babin | 204/12 |

FOREIGN PATENT DOCUMENTS

| | | | |
|---|---|---|---|
| 910844 | 9/1972 | Canada | 204/281 |

*Primary Examiner*—F. Edmundson

*Attorney, Agent, or Firm*—Blanchard, Flynn, Thiel, Boutell & Tanis

[57] ABSTRACT

A cathode base plate for electrolytic refining is disclosed wherein an insulating material is mounted on both sides of a part of said base plate at which a stripping means is inserted for peeling off an electrodeposited metal from the base plate, a part of said insulating material being embedded in holes passing through the base plate.

7 Claims, 11 Drawing Figures

CATHODE BASE PLATE FOR ELECTROLYTIC REFINING

BACKGROUND OF THE INVENTION

This invention relates to improvements in cathode base plates for electrolytic refining.

According to conventional electrolytic refining methods, nonferrous metals have been obtained by electrodepositing a nonferrous metal onto a cathode base plate (which will be referred to as "base plate" hereinafter) installed within an electrolytic cell to thereby prepare a cathode plate with electrodeposited metal formed thereon (which will be referred to as "cathode plate" hereinafter). The electrodeposited metal plate (which will be referred to as the "metal plate") is then peeled off from the base plate by inserting a stripping means such as wedge, scraper, knife or the like between the base plate and the metal plate together constituting the cathode plate.

FIGS. 1 and 2 are side sectional views illustrating two exemplary cathode plate embodiments A′ and A″ according to the prior art. In the cases of cathode plates A′ and A″, automatic stripping apparatuses have usually been employed for the purpose of peeling off the metal plate 2′ or 2″ from the base plate 1′ or 1″ respectively.

With reference to the case of the cathode plate A′, the stripping operation is carried out first by causing a mechanical impact or fluid impact at the ends 3′ of the metal plates 2′ respectively by means of a hammer or the like or by an air jet or the like, thereby forming fine voids in the border line between the base plate 1′ and the metal plate 2′, and then a stripping means (not shown) is inserted therethrough.

However, this cathode plate A′ is noted to be defective in that said border line 7′ is obscure because the edge portion 3′, as is evident from the drawing, forms an acute angle with the base plate 1′, and thus hinders insertion of the stripping means.

The cathode plate A″ obtained by forming a narrow portion on a part of the side edge of the base plate 1″, mounting a channel-shaped insulating material 4″ thereon so as to cover both sides thereof, the thickness of said insulating material 4 being identical to that of the base plate 1″ (as illustrated) or less than the thickness of the base plate 1″, and electrodepositing the metal plates 2″ thereon.

In this case, the stripping operation is carried out by forming fine voids in the border line 7″ between the plates 1″ and 2″ in the same way as employed in the case of cathode plate A′ and inserting the stripping means thereinto.

The cathode plate A″, since its border line 7″ is more distinct than that of the cathode plate A′, can facilitate insertion of the stripping means, but on the other hand it is noted to be defective in that the insulating material 4″ is liable to fall off the base plate 1″ because of the impact caused during the transportation of the base plate 1″, corrosion by electrolyte and the like, whereby the insertion of the stripping means is made still more difficult. It is thus required to mount a new insulating material 4 thereon again in order to successfully overcome the difficulty as aforesaid.

SUMMARY OF THE INVENTION

It is an object of this invention to provide an improved base plate which is capable of eliminating the aforesaid drawbacks inherent in conventional base plates as well as readily achieving the stripping operation of a metal plate by using a stripping means for a long period of time.

According to this invention, the aforesaid object can be attained by the provision of a base plate on which an insulating material is mounted on both sides of the part at which the stripping means is inserted for the purpose of peeling off the deposited metal plate from the base plate, a part of said insulating material being embedded in holes passing through the base plate. In other words, the base plate as disclosed in this invention is utterly free of the problem wherein the insulating material falls down from the base plate owing to the impact exerted on and corrosion caused on the base plate. This result is attained because the insulating material is rigidly connected to the base plate by the aid of the portions of it that are embedded in the through holes perforated in the base plate, and as a result the base plate according to this invention can endure repeated uses extending over a long period time.

DETAILED DESCRIPTION OF THE INVENTION

Figure 1:
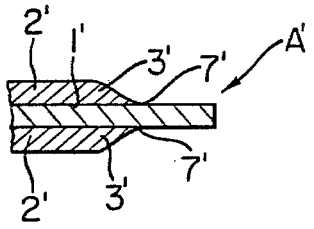
FIG. 1 PRIOR ART
FIG. 1 is a sectional view illustrating a fragment of a conventional base plate.
Figure 2:
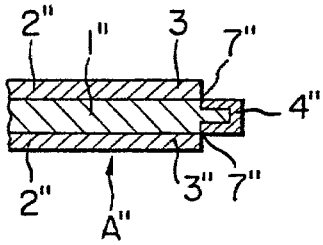
FIG. 2 PRIOR ART
FIG. 2 is a sectional view illustrating a fragment of another conventional base plate.
Figure 3:
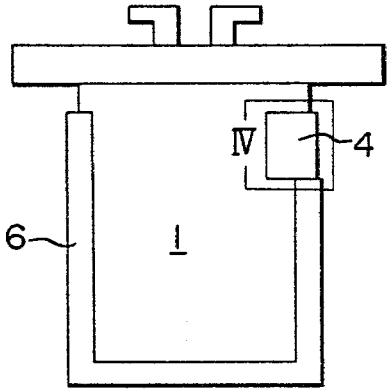
FIG. 3 is a front view of the base plate of the present invention.
Figure 4:
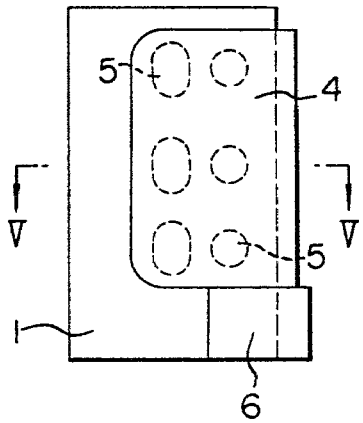
FIG. 4 is an enlarged front view of the portion IV of FIG. 3.
Figure 5:
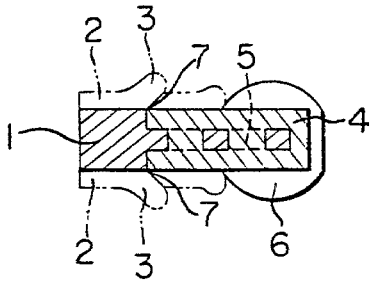
FIG. 5 is a sectional view taken on line V—V of FIG. 4.

FIGS. 3 to 5 illustrate a first embodiment which is so constructed that an insulating material 4 is mounted on a base plate 1 at the portion at which a stripping means (not shown) is inserted, namely the portion IV above the right side edge of the body 1 in FIG. 3 in such a manner that said side edge is embedded within the insulating material 4. The insulating material 4 is comprised of a plastic such as epoxy or polyester resin and the like, or rubber, and it has a thickness of about 2 mm on either side the side edge of the base plate. Through holes 5 are perforated beforehand in the base plate 1, and the insulating material 4 is mounted on both sides of the base plate 1 and is embedded in said through holes 5, whereby both sides of the insulating material are connected together so as to have a total thickness of about 6 mm which is substantially identical to that of the base plate 1.

In this context, reference numeral 6 denotes a conventional insulating material frame for separating the metal plate formed on both sides of the base plate 1.

FIG. 5 illustrates a metal plate 2 formed by using the aforesaid base plate, wherein its peripheral edge portion 3 has a profile as depicted by the broken line therein and is at an obtuse angle relative to the base plate 1, whereby a wedge-like gap suitable for inserting the stripping means is formed in the border line 7 therebetween.

Since the portions of the insulating material 4 embedded in the through holes of the base plate 1 function to rigidly connect the portions of the insulating material 4 mounted on both sides of the base plate 1 together, there is no possibility of the insulating material 4 being peeled off or falling down from the base plate 1 even when base plate 1 is subjected to an impact or corrosion attacks it.

Figure 6:
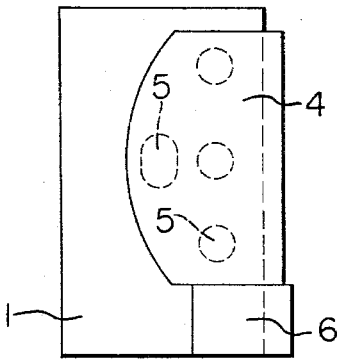
FIGS. 6 and 7 are partial front views illustrating the base plates of this invention with different shaped insulating materials mounted thereon.
Figure 7:
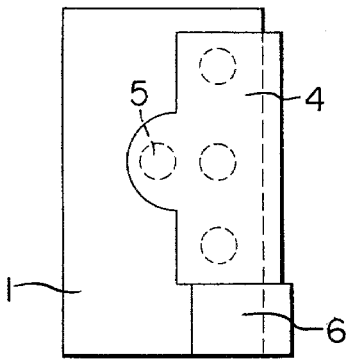
Figure 8:
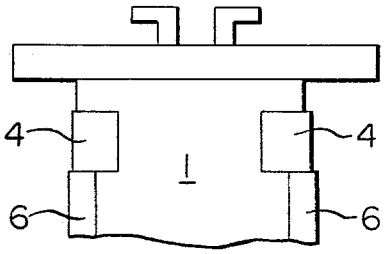
FIGS. 8 and 9 are partial views illustrating the base plates of this invention with two additional differently shaped insulating materials mounted thereon, respectively.
Figure 9:
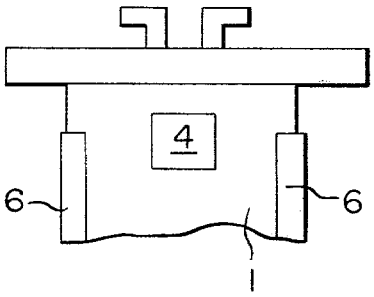
Figure 10:
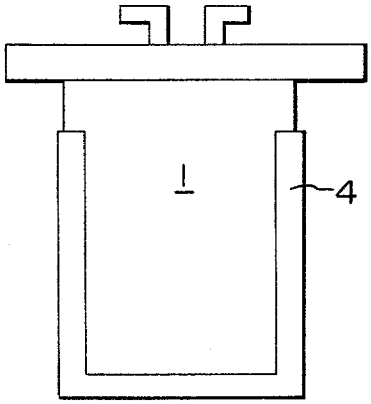
FIGS. 10 and 11 are front views illustrating the base plates of the invention with two more additional differently shaped insulating materials mounted thereon.
Figure 11:
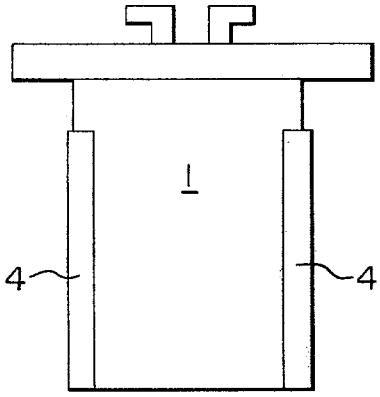

FIGS. 6 and 7 illustrate modifications of the insulating material 4, and especially when using the insulating material as illustrated in FIG. 7, a wedge-like space tends to be formed at the border line between the base plate 1 and the peripheral edge portion 3 of the metal plate 2 is correspondingly enlarged. FIGS. 8 to 11 illustrate examples of base plates prepared by variously changing the position at which the insulating material 4 is to be mounted.

The above described embodiments of this invention are advantageous because the insulating material mounted on a part of the surface of the base plate serves to put the peripheral edge portion of the metal plate adjacent thereto in a readily as well as rapidly strippable state. In addition, the stripping operation can be carried out readily as well as rapidly, and excessive damage to the base plate can be reduced markedly. Since a part of the insulating material is embedded in the holes perforated in the body of the base plate, the insulating material on the body is thereby rigidly mounted with the result that there is no possibility of the insulating material peeling off or falling off of the body even though the base plate may possibly be subjected to impacts during transportation, and in spite of corrosion caused in the course of the electrolytic operation.

What is claimed is:

1. A cathode base plate useful for the electrolytic refining of nonferrous metals, comprising an elongated, electroconductive plate having a central area adapted to receive an electrodeposited nonferrous metal layer on one or both sides thereof, said plate having vertical marginal side edge portions, the upper region of one of said side edge portions having a plurality of through holes arranged in a vertical row and at least one additional through hole horizontally offset from said vertical row of holes; a unitary member made of electrical insulating material mounted on said upper region, said member comprising layers covering the opposite surfaces and the edge of said upper region and including integral portions penetrating through and filling said through holes whereby said member is fixedly attached to said plate, said member having a height and width sufficient to permit a stripping means to be moved thereover to strip off said electrodeposited metal layer or layers from said plate.

2. A cathode plate useful for the electrolytic refining of nonferrous metals, comprising an electroconductive base plate of relatively large length and width and relatively small thickness, said plate having a central area adapted to receive an electrodeposited nonferrous metal layer on one or both sides thereof, said plate having a pair of vertical marginal side edge portions, the upper region of at least one of said marginal side edge portions being of reduced thickness relative to said central area, a pair of electrical insulating frame sections respectively mounted on said side edge portions of said base plate and covering the opposite surfaces and the edges of said side edge portions except for said upper region of said one side edge portion, said upper region having a plurality of through holes arranged in a vertical row and at least one additional through hole horizontally offset from said vertical row of holes; a unitary insulating member separate from said frame sections, said member being made of electrical insulating material and being mounted on said upper region and covering both sides and the side edge of said upper region and filling said holes such that said member is rigidly affixed to said upper region of said plate and covers same, the opposite surfaces of said member being substantially flush with the opposite surfaces of said central area of said base plate, the lower edge of said member substantially abutting the upper edge of the frame section disposed therebelow, said member having a height and width sufficient to permit a stripping means to be moved thereover to strip off said electrodeposited metal layer or layers from said plate.

3. A cathode plate as claimed in claim 2, wherein similar upper regions and insulating members are provided on both side edge portions of said base plate.

4. A cathode base plate as claimed in claim 2, wherein said upper region has six holes arranged in two horizontally offset, parallel, vertical rows of three holes each.

5. A cathode base plate as claimed in claim 2, wherein said upper region has four holes therein, three of said holes being arranged in a vertical row and the fourth hole being horizontally offset from said row at approximately the middle thereof.

6. A cathode plate as claimed in claim 2, wherein said insulating member is made of a material selected from the group consisting of epoxy resin, polyester resin and rubber.

7. A cathode plate as claimed in claim 2, wherein said insulating member projects laterally inwardly beyond the inner edge of its associated frame section, and said additional hole also is located laterally inwardly of the inner edge of its associated frame section, and said frame sections are of greater thickness than said insulating member.

* * * * *